US005636398A

United States Patent [19]

Fike

[11] Patent Number: 5,636,398

[45] Date of Patent: Jun. 10, 1997

[54] MULTIPLE APPLICATION HAND TOOL

[76] Inventor: Russel R. Fike, P.O. Box 65, Raymond, Calif. 93653

[21] Appl. No.: 392,088

[22] Filed: Feb. 22, 1995

[51] Int. Cl.[6] ..... B25B 7/22

[52] U.S. Cl. ..... 7/137; 7/117

[58] Field of Search ..... 81/20, 23; 7/117, 7/127, 137, 143, 146, 147, 164

[56] References Cited

U.S. PATENT DOCUMENTS

| | | | |
|---|---|---|---|
| 277,420 | 5/1883 | Gore . | |
| 402,939 | 5/1889 | Kincaid . | |
| 724,669 | 4/1903 | Cottrell | 7/117 |
| 772,574 | 10/1904 | McDowell . | |
| 1,074,380 | 9/1913 | Pearson | 7/117 X |
| 1,227,372 | 5/1917 | Bledsoe . | |
| 1,293,966 | 2/1919 | Springer . | |
| 1,344,114 | 6/1920 | Carlson . | |
| 1,364,829 | 1/1921 | Berg | 7/137 X |
| 1,565,611 | 12/1925 | Ade | 81/20 X |
| 1,823,494 | 9/1931 | Jacobs . | |
| 1,879,402 | 9/1932 | Monahan | 7/137 X |
| 2,462,250 | 2/1949 | Andrews . | |
| 2,572,237 | 10/1951 | Andrews . | |
| 2,762,604 | 9/1956 | Mission . | |
| 3,241,814 | 3/1966 | Forte . | |
| 3,310,288 | 3/1967 | Berry . | |
| 3,583,673 | 6/1971 | Poskin . | |
| 3,698,689 | 10/1972 | Poskin . | |
| 4,026,521 | 5/1977 | Clark . | |
| 4,049,236 | 9/1977 | Grill et al. . | |
| 4,290,583 | 9/1981 | Lombardi | 81/20 X |
| 4,293,119 | 10/1981 | Diederichs . | |
| 4,614,001 | 9/1986 | Liou . | |
| 5,035,400 | 7/1991 | Altenbach, Jr. . | |

FOREIGN PATENT DOCUMENTS

| | | | |
|---|---|---|---|
| 120555 | 12/1947 | U.S.S.R. | 7/117 |
| 20246943 | 1/1980 | United Kingdom | 7/137 |

*Primary Examiner*—D. S. Meislin
*Attorney, Agent, or Firm*—Worrel & Worrel

[57] ABSTRACT

A multiple application hand tool adapted for constructing or repairing wire fences, the tool having a pair of body members interconnected for substantially pivotal movement relative to each other about an axis of reference between a first operational position and a second operational position, the body members individually having head portions engageable with each other in the first operational position to form a substantially unitary hammer head and claw extending substantially in opposite directions from each other on one side of the axis of reference and handle portions deployed on the opposite side of the axis of reference for movement of body members between the first and second operational positions and individually having grasping surfaces deployed for grasping engagement with a wire for tensioning of the wire using the handle portions.

2 Claims, 2 Drawing Sheets

MULTIPLE APPLICATION HAND TOOL

BACKGROUND OF THE INVENTION

1. Field of the Invention

The present invention relates to a multiple application hand tool and, more particularly, to such a hand tool which is uniquely well suited to the construction and repair of work objects such as wire fences and the like.

2. Description of the Prior Art

There are many environments in which an individual must be prepared to perform any one or more of a plurality of work operations during daily rounds without knowing in advance which work operations will be necessary. This relatively common human experience is complicated in those situations in which the individual is limited as to the weight and/or storage capacity available for transporting tools, supplies and the like necessary for the performance of the tasks which may be encountered.

One such environment which clearly demonstrates these difficulties is that of raising livestock, such as sheep, cattle, or other domestic or wild animals. While this environment is discussed herein only as a representative example of a multitude of such environments, it does exemplify those environments where these difficulties are particularly acute. The raising of livestock requires that lengthy perimeters be patrolled on a regular basis by personnel to confirm that the perimeters are secure and to look for and repair any breaches therein. Typically, these perimeters are defined by wire fences of the barbed wire type wherein a plurality of barbed wire strands are secured in vertically spaced, substantially parallel relation on fence posts buried in the earth in substantially equally spaced relation. Such fences typically employ four or five such vertically spaced, barbed wire strands. The perimeters bound by such fences may be relatively short, but frequently extend for many miles. In the largest ranches, these perimeters may extend for hundreds of miles.

A variety of conditions may develop which require that the fence be repaired or replaced. The livestock may become entangled or otherwise ensnared in the fence wires requiring that they promptly be freed to avoid death or serious injury. The causes of such entanglements are diverse, but relatively common. The animals may bear against the fence in an effort to reach grass or other feed just beyond the fence. Other animals may press the animal into the fence. The animals may become frightened and attempt to break through the fence. In other instances, the perimeter fences may be breached as a result of normal wear and deterioration, or by natural phenomena such as inclement weather, erosion or the like. For all of these and other reasons, the frequency with which perimeter fences must be patrolled is significant and such personnel must be equipped with sufficient tools and materials to remove the animals from entanglement and otherwise to effect repairs of the fences.

Furthermore, the perimeter fences must be repaired immediately upon discovery to avoid injury to, or escape of, livestock. Of necessity, such repair must be performed by personnel at the time of the discovery of the condition using whatever tools and materials may be available for the purpose. Due to the rough terrain through which perimeter fences frequently extend, the personnel typically use horses or four wheel drive, off road vehicles in making their rounds. The weight and storage capacities are thus limited. Yet the variety of tools and materials which may be required for such on site duties is extensive. For example, one of the methods employed in repairing broken fence wires is known as the "Miller and Lux Splice." In essence, this method involves the forming of loops, or eyes, in each broken end portion of the wire, cutting of a length of wire to use as the splice wire, interconnecting the eyes of the broken ends of wire with the splice wire and tightening the splice wire in such a way as to apply the desired tension to the wire along the fence. The tools conventionally required for the performance of this operation may include a hammer, staple puller, pliers, wire cutters, crowbar and perhaps a variety of other tools. The limitations of space and weight to which reference has previously been made, severely hampers, or substantially prevents, the transport of such a variety of tools.

Therefore, it has long been known that it would be desirable to have a multiple application hand tool which is capable of performing a multiplicity of functions; which essentially permits a single tool to be employed in the performance of a multiplicity of functions so as to alleviate the need for carrying a plurality of hand tools individually capable of performing only a single such function; which has particular utility in the repair and replacement of wire fences such as are utilized in containing livestock and the like; which has wide application for a multiplicity of uses so as to achieve virtually universal applicability; and which is otherwise entirely successful in performing its various functions.

SUMMARY OF THE INVENTION

Therefore, it is an object of the present invention to provide an improved hand tool adapted to the performance of a multiplicity of tasks.

Another object is to provide such a hand tool which possesses a simplicity of structure including uniquely interoperable components permitting it to perform a plurality of functions in a single, readily operable hand tool.

Another object is to provide such a hand tool which is widely adaptable to the performance of a virtually unlimited number of work operations so as to be a virtually universally applicable hand tool.

Another object is to provide such a hand tool which is uniquely wall suited to the performance of such work operations as the repair, replacement or installation of wire fences such as are employed in containing livestock and which may extend many miles.

Another object is to provide such a hand tool which can be carried by personnel who travel along perimeter fences to look for breaches or other conditions requiring repair permitting such personnel to make the repair or to replace ate section of fence without having to carry a plurality of hand tools for this purpose.

Another object is to provide such a hand tool which has particular utility in forming the "Miller and Lux Splice" used in repairing broken wires in fences.

Further objects and advantages are to provide improved elements and arrangements thereof in an apparatus for the purpose described which is dependable, economical, durable and fully effective in accomplishing its intended purpose.

These and other objects and advantages are achieved, in the preferred embodiment of the applicant's invention, in a multiple application hand tool having a pair of body members interconnected for substantially pivotal movement relative to each other about an axis of reference between a first operational position and a second operational position, the body members individually having head portions engageable with each other in the first operational position to form a substantially unitary hammer head and claw extending substantially in opposite directions from each other on one side of the axis of reference and handle portions deployed on the opposite side of the axis of reference for movement of the body members between the first and second operational positions and individually having grasping surfaces deployed for grasping engagement with a wire for tensioning of the wire using the handle portions by the application of force thereto.

DESCRIPTION OF THE PREFERRED EMBODIMENT

Figure 1:
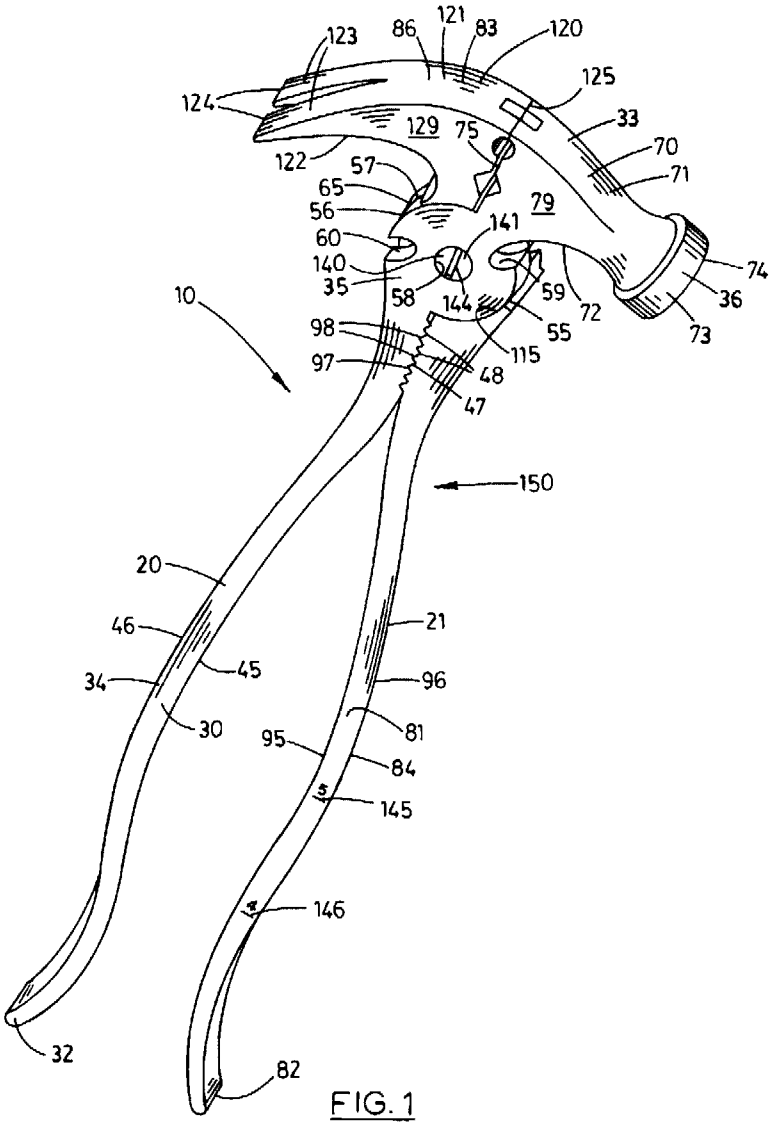
FIG. 1 is a top perspective view of the hand tool of the present invention showing principally the right side thereof.

Referring more particularly to the drawings, the multiple application hand tool of the present invention is generally indicated by the numeral 10 in FIG. 1. As shown in the drawings, the hand tool is composed of a first body member generally indicated by the numeral 20 and a second body member generally indicated by the numeral 21. Both the first and second body members are preferably constructed of high strength steel. Turning first to the first body member 20, it may be viewed as having an exterior side surface 30 and an opposite interior side surface 31. The terms "exterior" and "interior" have reference principally to the interconnection of the first and second body members, as will hereinafter be described. The first body member has a lower end 32 and an opposite upper end 33. Similarly, the first body member may be viewed as having a handle portion 34, a central portion 35 and a head portion 36.

The handle portion 34 may be viewed as having a flat interior surface 45 and an opposite flat exterior surface 46. At the upper end of the handle portion of the first body member is an inwardly facing grasping surface 47 defining a plane extending longitudinally of the hand tool and having a plurality of ridges or teeth 48 extending thereacross.

Figure 3:
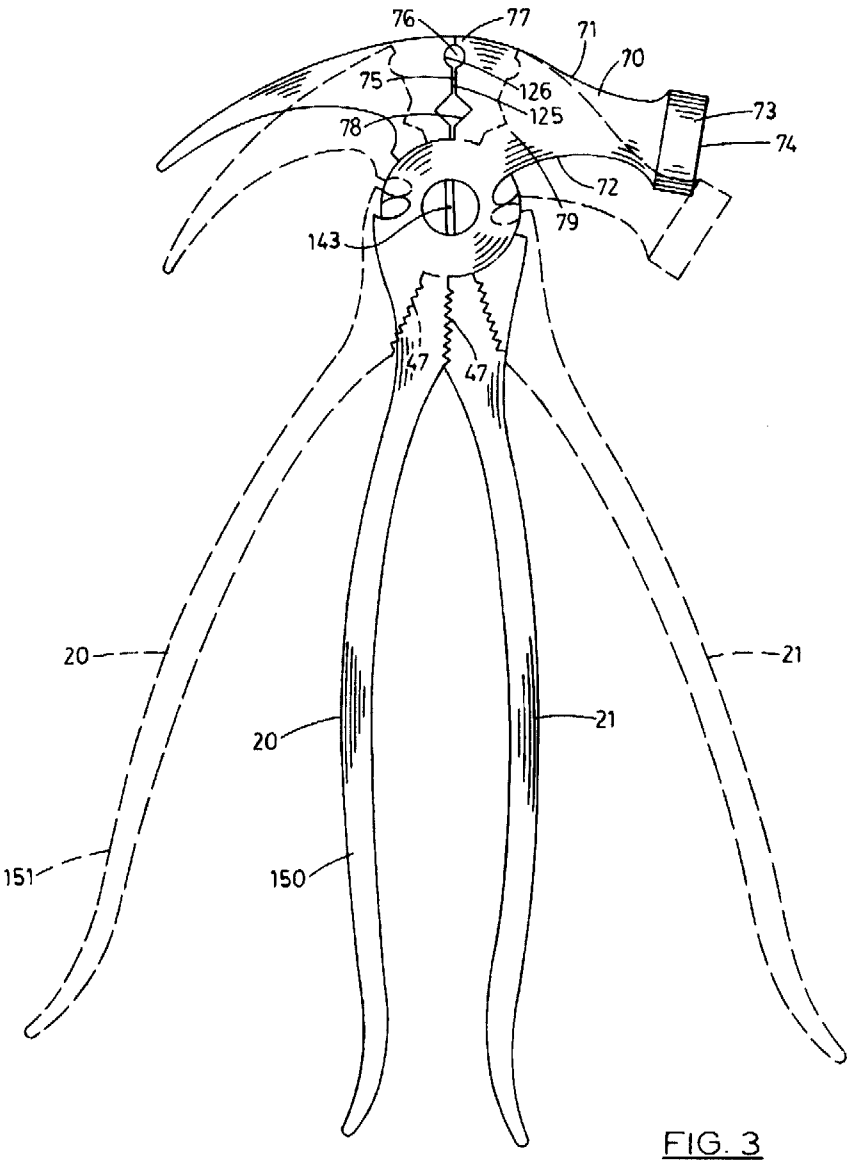
FIG. 3 is a side of the hand tool of the present invention showing the hand tool in full lines in a first operational position and in phantom lines in a second operational position.

The central portion 35 of the first body member 20 has a forward convex arcuate surface 55 and a rearward convex arcuate surface 56. The central portion has a flat interior pivot surface 57 defining a plane right-angularly related to the plane generally defined by the grasping surface 47 thereof. A cylindrical central passage 58 extends through the central portion of the first body member along a path right-angularly related to the interior pivot surface. The central portion of the first body member has a forward slot or receptacle 59 which, as best shown in FIG. 3, extends upwardly and forwardly at the angle shown in FIG. 3. Similarly, the central portion of the first body member has a rearward slot or receptacle 60 which extends rearwardly and slightly upwardly, as best shown in FIG. 3. It will be seen that the attitude of the rearward slot or receptacle is at less of an angle to horizontal than is the forward slot or receptacle 59. Both the forward and rearward receptacles are, bounded by lateral edges which are of sharp, right angular configurations.

The central portion 35 of the first body member 20 has a rear concave, arcuate surface 65 which is concentric to the central passage 58 of the central portion.

The head portion 36 of the first body member 20 has a hammer head generally indicated by the numeral 70. The hammer head has a transversely flat and longitudinally slightly curved upper surface 71. The hammer head has a transversely flat and longitudinally arcuate lower surface 72. As can best be seen in FIG. 3 in full lines, the lower surface 72 extends in an arc into feeding relation to the forward receptacle 59 of the central portion 35. The purpose for this relationship will subsequently be described. The hammer head has an impact head 73 having a waffled impact surface 74 defining a plane right-angularly related to the plane of the drawing surface of FIG. 3. The hammer head has a rear surface 75 defining a plane which is co-axial with the central passage 58. An upper transverse passage 76 is formed in the rear surface 75 defining an axis parallel to the axis defined by the central passage 58. The upper transverse passage is bounded by a pair of prongs 77 best shown in FIGS. 1 and 2. A lower transverse passage 78 extends inwardly of the rear surface 75 extending along a course parallel to the upper transverse passage 76. The lower transverse passage is right-angularly shaped in cross section, as best shown in FIG. 3. The head portion 36 of the first body member 20 is bounded by substantially parallel side surfaces 79 which are right-angularly related to the rear surface 75 of the head portion.

As can be visualized in the drawings, the second body member 21 is in many respects, substantially identical to the first body member 20. Thus, the second body member has an exterior side surface 80 and an opposite interior side surface 81. The second body member has a lower end 82 and an opposite upper end 83. The second body member may be viewed as having a handle portion 84, a central portion 85 and a head portion 86.

The handle portion 84 of the second body member 21 has a flat interior surface 95 and an opposite flat exterior surface 96. The handle portion has a grasping surface 97 across which extend a plurality of ridges or teeth 98. When the handle portions 34 and 84 of the first and second body members are disposed in the positions shown in FIGS. 1, 2 and in full lines in FIG. 3, the grasping surfaces 47 and 97 thereof are placed in substantially facing engagement with the respective teeth and 98 thereof disposed in mating engagement.

Figure 2:
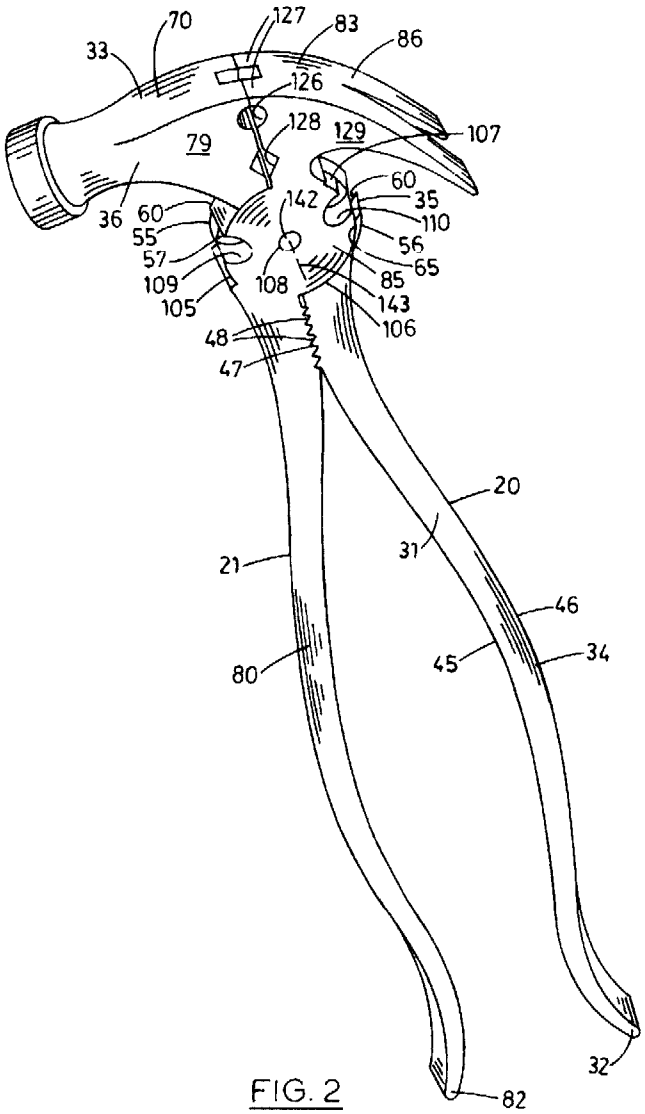
FIG. 2 is a top perspective view of the hand tool of FIG. 1 showing principally the left side thereof.

The central portion 85 of the second body member 21 has a forward convex arcuate surface 105 and an opposite, rearward convex arcuate surface 106. The central portion has a flat interior pivot surface 107 disposed in facing engagement with the interior pivot surface 57 of the first body member 20. The central portion has a central passage 108 which extends through the central portion in right angular relation to the flat interior pivot surface and in axial alignment with the central passage 58 of the first body member. The central portion of the second body member has a forward slot or receptacle 109 and an opposite rearward slot or receptacle 110. As can be seen in FIGS. 1 and 2, the forward receptacle 109 of the second body member is disposed at an angle to horizontal less than the corresponding receptacle 59 of the first body member so that in the operational attitude shown in FIGS. 1, 2 and in full lines in FIG. 3, the forward receptacles 59 and 109 do not communicate with each other or, in other words, are rotated beyond such communication. Similarly, the rearward receptacle 110 of the second body member is disposed at a greater angle than the corresponding rearward receptacle 60 of the first body member so that in the operational attitude shown in FIGS. 1, 2 and in full lines in FIG. 3, the corresponding rearward receptacles 60 and 110 are rotated passed each other and do not communicate.

The second body member 21 has a forward concave surface 115 which, as shown in FIG. 1, overlays the forward convex arcuate surface 55 of the central portion 35 of the first body member 20.

The head portion 86 of the second body member 21 has a claw head generally indicated by the numeral 120. The claw head 120 has a transversely flat and longitudinally arcuate upper surface 121. The claw head has an arcuate lower surface 122 and a pair of claw prongs 123 extending to terminal ends 124. The head portion 86 has a front surface 125 which, in the operational attitude shown in FIGS. 1, 2 and in full lines in FIG. 3, is disposed in facing engagement with the rear surface 75 of the head portion 36 of the first body member 20. Upper transverse passage 126 extends inwardly of the front surface 125 in alignment with the upper transverse passage 76 of the first body member. The upper transverse passage 126 is bounded by a pair of prongs 127. A lower passage 128 extends inwardly of the front surface 125 below the upper transverse passage and in alignment with the lower passage 78 of the first body member. The lower passage 128 is transversely of a fight angular configuration so as, with the lower passage 78 of the first body member, to form a transversely square passage, as shown in full lines in FIG. 3. The head portion 86 of the second body member 21 has parallel side surfaces 129 individually coplanar with the side surfaces 79 of the first body member, as best shown in FIGS. 1 and 2.

The first body member 20 and the second body member 21 are pivotally interconnected by a pivot assembly 140 extending through the central passage 58 of the first body member and the central passage 108 of the second body member when aligned, as shown in the drawings. The pivot assembly is composed of a first mounting pin 141 received in the central passage 58 of the first body member and a second mounting pin 142 received in the central passage 108 of the second body member. The mounting pins 141 and 142 are releasably interlocked and define an axis of reference 143 for the hand tool about which the first and second body members are pivoted. The first mounting pin 141 has a screw driver slot 144 employed in releasing screw-threadably the first mounting pin from the second mounting pin to disassemble the hand tool, if desired.

The handle portion 84 of the second body member 21 has first and second measuring indicia 145 and 146, respectively, formed thereon by any desired means in predetermined spaced relation, as shown in FIG. 1. The first and second measuring indicia individually designate the standard distances between the wires of a wire fence. More specifically, the first measuring indicia 145 define a distance between the first measuring indicia and the upper surface 71 of the hammer head 70. This distance corresponds to the desired spacing between adjacent wires of a wire fence in which five wires are employed in equally vertically spaced, substantially parallel relation on the fence posts of the fence so formed. Similarly, the second measuring indicia 146 designate the distance between the second measuring indicia and the upper surface 71 of the hammer head 70. This distance corresponds to the desired spacing between adjacent wires of a wire fence having four such wires mounted in substantially parallel, vertically spaced relation on the fence posts.

For illustrative convenience, and as will hereinafter be described, the hand tool 10 is operable to position the first and second body members 20 and 21 in any desired positions between a first operational position 150 shown in FIGS. 1, 2 and in full lines in FIG. 3 and a second operational position 151 shown in phantom lines in FIG. 3.

OPERATION

The operation of the described embodiment of the subject invention is believed to be readily apparent and is briefly summarized at this point.

The hand tool 10 of the present invention is adapted for usage in virtually universal application. This is due to the fact that the operational sub-elements thereof can be employed in the performance of functions required in virtually all operational environments. However, as previously noted, the hand tool is uniquely well suited to those functions required in the construction, repair or replacement of wire fences such as are employed as perimeter fences in the raising of livestock. Accordingly, the operation of the preferred embodiment of the present invention will be described herein in this operative environment.

The hand tool 10 can be employed to perform any number of operations individually or in any combination. The hammer head 70 can be employed to drive nails or staples. The claw head 120 can be employed to remove nails, staples or wires. The pair of prongs 77 and the pair of prongs 127 can be employed in any combination to pull staples, as for example from fence posts, or, similarly to pull wire from fence posts, particularly in those instances where access is difficult. The gasping surfaces 47 and 77 can be used to grasp any object therebetween. Such gripping engagement can be used, for example, for gasping a wire for purposes of stretching the wire during the construction or repair of a fence. The forward receptacles 59 and 109 can be laterally aligned when the hand tool is in the second operational position 151. By sliding the hand tool, when in this position, over a wire so that the wire slides along the arcuate lower surface 72 of the hammer head 70, the wire is guided into the aligned receptacles. Then, by grasping the handle portions 34 and 84, the handle portions can be forced together in movement toward the first operational position 150 shown in full lines in FIG. 3. The wire is sheared between the sharpened edges bounding the forward receptacles 59 and 109 thereby severing the wire upon the hand tool reaching the first operational position. If more convenient, this same operation can be performed in the same manner using the rearward receptacles 60 and 110.

The lower passage 78 and 128 can be employed to hold a staple in an extended position at substantially right angles to the upper surfaces 71 and 121 with the leg portions of the staple extending along, and in facing engagement with, the side surfaces 79 and 129. The hand tool can thus be used to drive the prongs thereof into, for example a fence post, sufficiently to hold the staple in the desired position When this is done, the hand tool is then removed from the staple and the hammer head 70 employed to drive the staple into the fence post so as, for example, to mount a wire on the fence post at the precise location desired. Still further, the handle portions 34 and 84 can individually be employed by insertion through a loop in a wire to tighten the wire in any desired manner as in the manner of a crowbar. Similarly, the hammer head 70 in combination with the claw head 120 can be employed in any desired manner to loop a wire thereabout and thereafter to apply tension to the wire such as may be required during the formation of a "Miller and Lux Splice."

The distances defined by the first and second measuring indicia 145 and 146, respectively, can be used to locate the spacing distances on each fence post securing of the wires.

Obviously, these uses are merely representative of a multitude of individual uses which can be employed in any desired combination for the performance of virtually any types of work operations conventionally requiring the use of multiple hand tools.

Therefore, the multiple application hand tool is capable of performing a multiplicity of functions; essentially permits a single tool to be employed in the performance of a multiplicity of functions so as to alleviate the need for carrying a plurality of hand tools individually capable of performing only a single such function; has particular utility in the construction and repair of wire fences such as are utilized in raising livestock and the like; has wide application for a multiplicity of uses so as to achieve virtually universal applicability; and is otherwise entirely successful in performing its various functions.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. A multiple application hand tool particularly adapted for constructing and repairing wire fences, the hand tool comprising:

A. a first body member having 1. a head portion being so configured as to define a hammer head having an impact surface, a transversely flat and concave surface facing generally in a predetermined direction and a rear surface defining a plane substantially parallel to said impact surface,
2. a central portion mounted on the head portion and having forward and rearward convex arcuate surfaces substantially coaxially related to a pivot axis, a substantially flat pivot surface substantially right-angularly related to said pivot axis, a forward receptacle communicating with said transversely flat and concave surface of the head portion so as to form substantially a continuum thereof and a substantially cylindrical central passage concentric to said pivot axis, and
3. a handle portion mounted on the central portion having a grasping surface adjacent to the central portion generally defining a plane extending longitudinally of the hand tool;

B. a second body member having 1. a head portion so configured as to define a claw head having a pair of prongs and a front surface defining a plane disposed in a predetermined attitude relative to the second body member;
2. a central portion having forward and rearward convex arcuate surfaces substantially coaxially related to a pivot axis, a substantially flat pivot surface substantially right-angularly related to said pivot axis, a forward receptacle disposed in a predetermined position and a substantially cylindrical central passage concentric to said pivot axis, and
3. a handle portion mounted on the central portion and having a grasping surface adjacent to the central portion generally defining a plane extending longitudinally of the hand tool; and C. a pivot assembly extending through the central passages of the first and second body members pivotally to interconnect the first and second body members with said respective pivot axes thereof in substantial coincidence and with the respective pivot surfaces thereof in substantially facing engagement for substantially pivotal movement of the first and second body members relative to each other between a first operational position where, in said rear surface of the head portion of the first body member and front surface of the head portion of the second body member are disposed in substantially facing engagement, the respective receptacles of the first and second body members are off set relative to each other, the respective grasping surfaces thereof are disposed substantially in contact with each other and the respective handle portions thereof in adjacent spaced relation, and a second operational position, wherein said rear surface of the head portion of the first body member and the front surface of the head portion of the second body member, their respective grasping surfaces and their respective handle portions are spaced from each other and the respective receptacles thereof are disposed in substantial alignment whereby in said first operational position the hand tool can be employed to perform a plurality of work operations in the constructing and repairing of wire fences and the hand tool can be used to sever a wire by placing the hand tool in said second operational position substantially to align said receptacles, moving said wire to be severed along said transversely flat and concave surface of the head portion of the first body member and into said receptacles and thereafter moving the hand tool toward said first operational position to sever the wire substantially along a plane defined by the respective pivot surfaces of the first and second body members and wherein said head portions of the first and second body members have distal surfaces remote from the central portions thereof each having a pair of laterally spaced prongs adjacent to said distal surfaces bounding first passages defining longitudinal axes substantially parallel to said pivot axes, said pairs of prongs of the head portions being engageable with each other in the first operational position for use in grasping a staple, wire, and wherein said head portions of the first and second body members have second passages between said first passages and said pivot axes which, in said first operational position, communicate with each other to define a substantially rectangular cross section so as to be capable of retaining a staple in a deployed position for penetrating a fence post.

2. The tool of claim 1 wherein at least one of the handle portions bear indicia demarcating a predetermined distance from said distal surfaces of the head portions of the first and second body members for the vertical spacing of wires in a wire fence.

* * * * *

UNITED STATES PATENT AND TRADEMARK OFFICE

CERTIFICATE OF CORRECTION

PATENT NO. : 5,636,398

DATED : June 10, 1997

INVENTOR(S) : RUSSEL R. FIKE

It is certified that error appears in the above-identified patent and that said Letters Patent is hereby corrected as shown below:

Column 2, line 41, delete "wall" and insert ---well---;

line 48, delete "ate" and insert ---the---;

Column 3, line 16, insert between "side" and "of" ---elevation---;

Column 4, line 41 after "respective teeth" insert ---48---;

Column 5, line 19, delete "fight" and insert ---right---;

Column 6, line 44, insert a period after ---position---;

line 58, after "post" insert ---for---; and

Column 8, line 7, delete "position where, in" and insert ---position, wherein---.

UNITED STATES PATENT AND TRADEMARK OFFICE

CERTIFICATE OF CORRECTION

PATENT NO. : 5,636,398

DATED : June 10, 1997

INVENTOR(S) : RUSSEL R. FIKE

It is certified that error appears in the above-indentified patent and that said Letters Patent is hereby corrected as shown below:

In the ABSTRACT, line 12, before "body members" insert ---the---.

Signed and Sealed this

Fifth Day of August, 1997

Bruce Lehman

*Attest:*

BRUCE LEHMAN

*Attesting Officer*

*Commissioner of Patents and Trademarks*